United States Patent [19]

Shannon

[11] Patent Number: 4,951,996

[45] Date of Patent: Aug. 28, 1990

[54] MUSICIAN'S PORTABLE SEAT

[76] Inventor: Daniel T. Shannon, 1353 W. Superstition Blvd., Apache Junction, Ariz. 85220

[21] Appl. No.: 347,190

[22] Filed: May 4, 1989

[51] Int. Cl.[5] ..... A47C 4/00

[52] U.S. Cl. ..... 297/42; 297/44; 108/159

[58] Field of Search ..... 108/159, 124; 297/42, 297/44, 461

[56] References Cited

U.S. PATENT DOCUMENTS

| | | | |
|---|---|---|---|
| 2,873,156 | 2/1959 | Botnick | 108/124 |
| 3,106,295 | 10/1963 | Berlin | 108/159 |
| 3,193,848 | 7/1965 | Levy | 108/48 |
| 3,215,096 | 11/1965 | Holtz | 108/159 |
| 3,841,728 | 10/1974 | Petersen et al. | 108/159 |
| 3,971,327 | 9/1976 | Critchett | 108/159 |
| 4,108,490 | 8/1978 | Marin | 297/331 |

*Primary Examiner*—Francis K. Zugel
*Attorney, Agent, or Firm*—James F. Duffy

[57] ABSTRACT

A portable seat having a stable three-legged frame, one leg of the frame being bifurcated with each of its bifurcations being coupled such that the remaining two legs may be drawn close to or away from each other. A seating element is releasably coupled to the top of the frame and maintains it in its useful position. The seating element may be coupled to the side of the frame when the frame is folded for storage or transport. Footrests are provided by the coupling of horizontal members to the frame at various positions thereon.

7 Claims, 1 Drawing Sheet

MUSICIAN'S PORTABLE SEAT

BACKGROUND

1. Field of the Invention

The invention relates to seats which may be folded for storage or transport. In particular, the invention relates to a three-legged stool which folds into a relatively flat package.

2. Prior Art

Chairs and seats having three points of support are quite stable. This is because three points determine a plane and so a three-legged seat may always be established with all support surfaces lying within a given plane even though the surface on which the seat is emplaced is generally rough and uneven. Among people who travel frequently, such as campers, musicians, and the like, a need exists for a seat which may be folded to a small package for ease of transport and storage. The need is particularly demonstrated amongst musicians who have a need for a seat which allows them freedom of movement and provides then with the ability to rest their feet at various levels above the floor. Such needs are seldom met by chairs or seats, which may be available at the place at which the musicians are performing. It is thus that musicians frequently carry stools and the like with them when they move from job to job. The difficulty of transporting standard stools and the like adds to the burden the musician has in transporting his musical equipment from job to job.

In U.S. Pat. No. 4,359,243, Crutcher discloses a seat suggested for use by musicians. The primary aspect of the seat is the seating element itself which has an elongated side to provide support for the thigh of a person seated on the chair whereas the other side of the seat element is cut away to permit that leg freedom of movement. Crutcher does present a folding arrangement of a chair utilizing his seating element but the mechanics whereby the seat is folded eliminates the advantage of the three point support. Crutcher requires that the seat element be permanently attached to the frame. This arrangement limits Crutcher's ability to design a collapsible frame in a manner other than that disclosed by him in the subject patent.

It is interesting to note that Crutcher discloses a stool having a three point support. The stool, however, is a fixed structure and is not collapsible for ease of transport. Crutcher then discloses two other structures which are capable of being collapsed for transport but do not provide a three point support when erected for use by a person. In addition, a person using a seat of Crutcher's design is provided with no footrests for raising his feet to differing levels above the floor. At best, a person utilizing Crutcher's seat would be able to rest his heel on the lower reinforcing member which has an edge resting on the floor. It should also be noted that the rectangular structure of Crutcher's folding seat is inherently a weak structure. Unlike a structure with triangular elements in it, rectangular structures tend to distort when subjected to force moments such as may be encountered on a seat as a person shifts his position.

It is an object of the present invention to provide a stool having cross members at several levels to provide footrests for a person using the stool; a stool having the capability to fold into a compact package for ease of storage and transport. The frame of the innovative stool disclosed herein is rugged and capable of being subjected to rough handling such as may be encountered by the frequent transport requirements of musicians, campers, and the like.

SUMMARY OF THE INVENTION

The invention is a portable, collapsible seat. The seat comprises first and second truncated, A-frame shaped members each having a first and a second side. Pivotal means couple a first side of the first member to a first side of the second member. In this way, the pivotally coupled first sides form a bifurcated leg and the remaining second sides of the first and second members form second and third legs, respectively, of a portable, three-legged seat frame.

The first and second members each further comprise a first cross element coupling the first and second side of the member. Each first cross element is generally horizontal when the three-legged seat frame stands on a horizontal plane.

There is a seat which has coupling means for removably coupling the seat to at least one of the first cross elements. The first and second members each further comprise a second cross element coupling the first and second side of the member at a selected position between the first cross element and the distal ends of the first and second sides of the member. Thus, a person siting on the seat, when the seat is coupled to the first cross element, may utilize a second cross element as a foot rest.

Seat coupling means are coupled to a second cross element. The seat coupling means are complementary in form to the coupling means for removably coupling the seat to the first cross element. By this arrangement, when the seat is decoupled from the first cross element, it may be then coupled to the second cross element for ease of transport and storage of the three-legged frame and the seat.

It is also disclosed that the means for removably coupling the seat to at least one of the first cross elements comprises means for removably coupling the seat to each of the first cross elements of the first and the second members. The removable coupling means thereby comprises a seat frame locking means by inhibiting movement of the pivotal means coupling the first and second members.

Also disclosed is the embodiment wherein the first and second members each further comprise a third cross element coupling the first and second side of the member. The third cross element is in spaced apart relationship to the second cross element and available for use as an alternate footrest. In this embodiment, the seat coupling means coupled to the second cross element is further coupled to the third cross element, whereby the seat, decoupled from the first cross elements, may be coupled between the second and the third cross elements for ease of transport and storage of the three-legged frame and the seat.

As disclosed and claimed, the means for removably coupling the seat to the first cross elements of the first and second members comprises a pair of generally U-shaped channel sections at least one leg of which section is resiliently flexible. The pair of channel sections is coupled to the seat and disposed such that each lies adjacent to the other with their axes defining a V having its apex coincident with the pivotal means.

A locking projection is coupled to the at least one flexible leg of each channel for extension beneath the first cross elements when a first cross element is removably coupled within each the U-shaped channel section. This locking projection also extends beneath the seat coupling means coupled to the second and third cross elements when the seat coupling means is coupled to the U-shaped channels.

A DETAILED DESCRIPTION OF THE INVENTION

Figure 1:
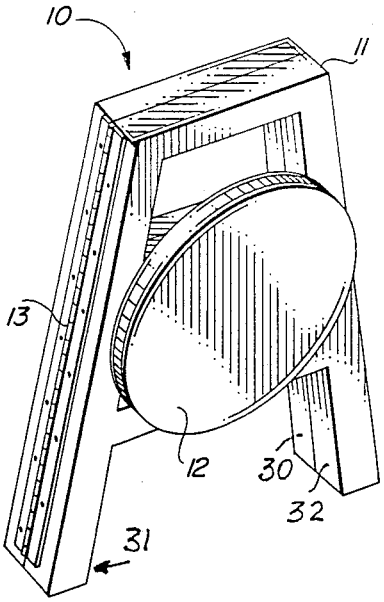
FIG. 1 illustrates the portable seat of the invention in its collapsed form with the frame folded and the seat coupled to the folded frame.

For purposes of promoting an understanding of the principles of the invention, reference will now be made to the embodiments illustrated in the drawings and specific language will be used to describe same. It will nevertheless be understood that no limitation of the scope of the invention is thereby intended, there being contemplated such alterations and modifications of the illustrated device, and such further applications of the principles of the invention as disclosed herein, as would normally occur to one skilled in the art to which the invention pertains.

FIG. 1 illustrates the invention, a portable seat 10, in its collapsed and folded state, ready for transport or storage. Frame 11 is an assembly of two truncated truss of A-frame shaped members. These members are coupled together by pivotal means, hinge, 13. When thus assembled, frame 11 comprises a three-legged frame. The three legs are denoted by the references 30, 31, and 32. It should be noted that leg 31 is a bifurcated leg having its bifurcations joined hinged 13. In the collapsed and folded state of the portable seat 10, illustrated in FIG. 1, a padded seat 12 is coupled to the side of frame 11 so that all elements of the invention 10 may be easily stored or transported.

Figure 2:
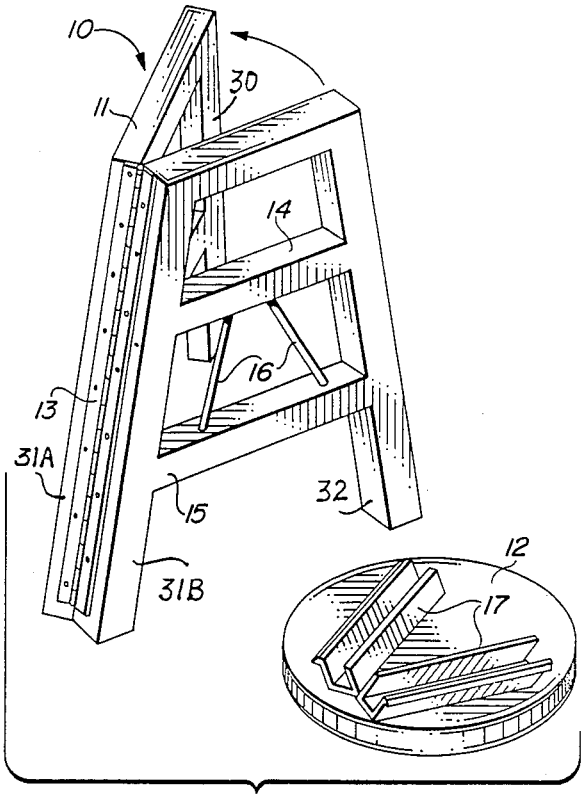
FIG. 2 illustrates the frame positioned in an open condition, supported at three points, awaiting the assembly of the seat thereto. The lower surface of the seat is illustrated showing the releasable coupling elements attached to the seating element.

Seat 12 has been removed from the side of frame 11 in the illustration of FIG. 2. Frame 11 has been opened by pivoting leg 32 away from leg 30, utilizing the pivotal capabilities of hinge 13. In the position shown in FIG. 2 frame 30 remains stably upright because the three legs establish a stable support base.

The underside of seat 12 is illustrated in FIG. 2. Coupled to the bottom of seat 12 and lying along intersecting lines thereon are a pair of releasable coupling elements 17. Coupling elements 17 releasably couple seat 12 to the top of frame 11. Note that only one releasable coupling element 17 would be necessary to maintain seat 12 atop frame 11. However, the use of two of these releasable coupling elements 17, because of their angular disposition one to the other, effectively locks legs 30 and 32 of frame 11 in a fixed displacement so that the assembled seat 10 becomes a stable structure as well as providing a stable three-point support for persons seated on seating element 12. The assembled, portable seat 10, with seating element 12 in place, is illustrated in FIG. 3.

Frame 11 is equipped with one or more horizontal members 14 and 15. These horizontal elements provide a person seated on seating element 12 with a place to rest his foot other than the floor. As to the positional relationship of horizontal members 14 and 15, horizontal member 14 provides a person with a relatively high footrest position, while horizontal member 15 provides a person with a relatively low footrest position.

Figure 3:
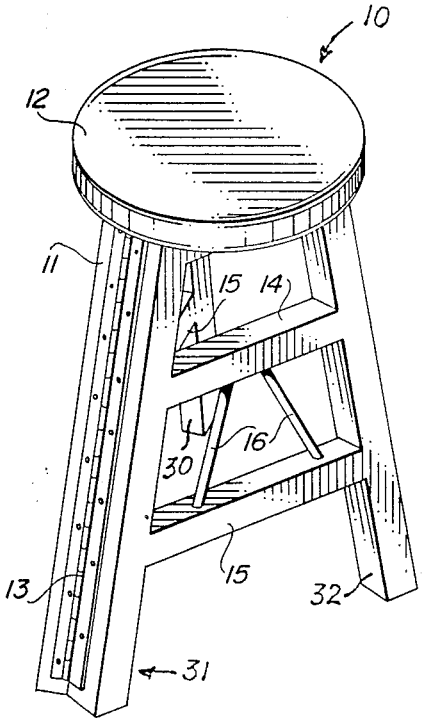
FIG. 3 illustrates the portable seat with the seating element in place.

As may be seen in FIG. 3, portable seat 10 provides a person using it with the ability to vary his position over the course of time and thus avoid the buildup of fatigue. A persons seated at seating element 12 may rest his feed on the floor or on any one of the footrests provided by horizontal members 14 and 15. These footrests are also convenient for use by musicians as an aid to positioning their leg to support the instrument they are playing.

Illustrated also in FIGS. 2 and 3 are two angularly disposed rods 16 coupled between horizontal members 14 and 15. These rods are so emplaced as to permit their coupling with the releasable coupling elements 17 on the underside of seating element 12. The effect of so coupling seating element 12 to rods 16 is illustrated in FIG. 1 where seating element 12 is coupled to the side of frame 11 for ease of transport and storage.

Figure 4:
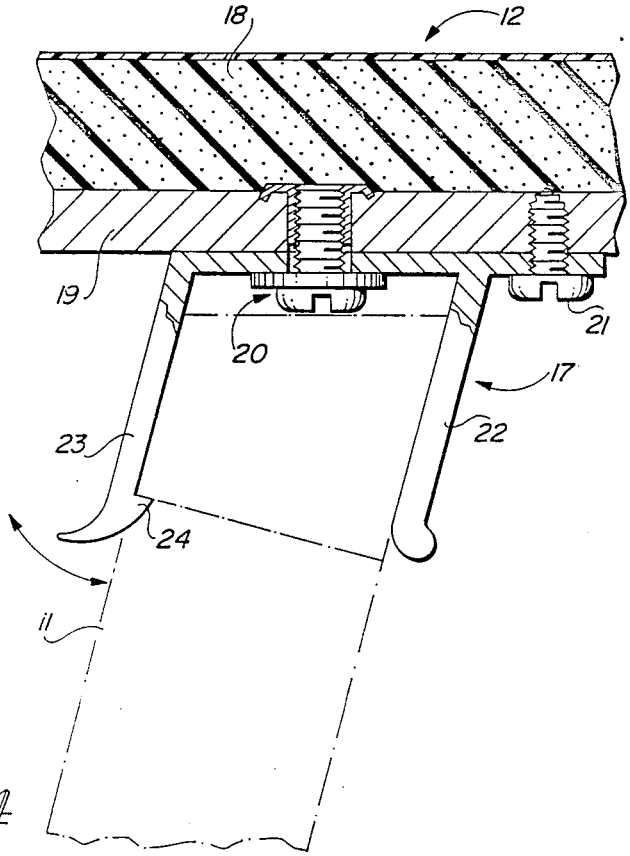
FIG. 4 illustrates the releasable coupling element and a suggested manner in which it is affixed to the base of the seating element of the invention.

A cross sectional view of seating element 12 and the manner in which it is coupled to releasable coupling element 17 is illustrated in FIG. 4. Seating element 12 may be comprised of a padded element 18 covering a stable base 19. Releasable coupling element 17 is a generally U-shaped channel affixed to seating element 12 by means of screw fasteners 20 and 21. The U-shaped channel of releasable coupling element 17 has two legs 22 and 23, at least one of which, 23, is resiliently flexible. Leg 23 is so formed as to include a locking projection 24 positioned so that it may engage with an object encompassed within the confines of the U-shaped, releasable coupling element 17. Locking projection 24 engages with the top of frame 11 while seating element 12 is placed atop frame 11 as illustrated in FIG. 3. Locking projection 24 also lockably engages with rods 16 at the side of frame 11 when seating element is emplaced for storage and transport as illustrated in FIG. 1.

What has been disclosed is a portable seat having a stable three-legged frame, one leg of the frame being bifurcated with each of its bifurcations being coupled such that the remaining two legs may be drawn close to or away from each other. A seating element is releasably coupled to the top of the frame and maintains it in its useful position. The seating element may be coupled to the side of the frame when the frame is folded for storage or transport. Footrests are provided by the coupling of horizontal members to the frame at various positions thereon.

Those skilled in the art will conceive of other embodiments of the invention which may be drawn from the disclosure herein. To the extent that such other embodiments are so drawn, it is intended that they shall fall within the ambit of protection provided by the claims herein.

Having described the invention in the foregoing description and drawings in such a clear and concise manner that those skilled in the art may readily understand and practice the invention, that which is claimed is:

1. A portable, collapsible seat comprising:

first and second truncated, A-frame shaped members each having a first and a second side;

pivotal means coupling a first side of said first member to a first side of said second member, whereby said pivotally coupled first sides form a bifurcated leg and the remaining said second sides of said first and second members form second and third legs, respectively, of a portable, three-legged seat frame;

said first and second members each further comprise a first cross element coupling said first and second side of said member, each said first cross element being generally horizontal when the three-legged seat frame stands on a horizontal plane;

a seat having coupling means for removably coupling said seat to at least one of said first cross elements;

said first and second members each further comprise a second cross element coupling said first and second side of said member at a selected position between said first cross element and the distal ends of said first and second sides of said member, wherein a person siting on said seat, when said seat is coupled to said first cross element, may utilize a said second cross element as a foot rest; and seat coupling means coupled to a said second cross element and complementary in form to said coupling means for removably coupling said seat to said first cross element, whereby, when said seat is decoupled from said first cross element, it may be coupled to said means coupled to said second cross element for ease of transport and storage of said three-legged frame and said seat.

2. The portable seat of claim 1 wherein said means for removably coupling said seat to at least one of said first cross elements comprises means for removably coupling said seat to each of said first cross elements of said first and said second members, said removable coupling means thereby comprising seat frame locking means by inhibiting movement of said pivotal means coupling said first and second members.

3. The portable seat of claim 2 wherein said first and second members each further comprise a third cross element coupling said first and second side of ssaid member, said third cross element being is spaced apart relationship to said second cross element and available for use as an alternate footrest, and said seat coupling means coupled to said second cross element is further coupled to said third cross element, whereby said seat, decoupled from said first cross elements, may be coupled between said second and said third cross elements for ease of transport and storage of said three-legged frame and said seat.

4. The portable seat of claim 1 wherein said coupling means for removably coupling said seat to said first cross element comprises:

a generally U-shaped channel section at least one leg of which is resiliently flexible; and a locking projection coupled to said at least one flexible leg for extension beneath said first cross element when said first cross element is removably coupled within said U-shaped channel section.

5. The portable seat of claim 1 wherein said coupling means for removably coupling said seat to said first cross element comprises:

a generally U-shaped channel section at least one leg of which is resiliently flexible; and a locking projection coupled to said at least one flexible leg for extension beneath said first cross element when said first cross element is removably coupled within said U-shaped channel section and for extension beneath said seat coupling means coupled to said second cross element when said seat coupling means is removably coupled within said U-shaped channel.

6. The portable seat of claim 2 wherein said means for removably coupling said seat to said first cross elements of said first and second members comprises:

a pair of generally U-shaped channel sections at least one leg of which section is resiliently flexible, said pair of channel sections being coupled to said seat and disposed such that each lies adjacent to the other with their axes defining a V having its apex coincident with said pivotal means; and a locking projection coupled to said at least one flexible leg of each channel for extension beneath said first cross elements when a said first cross element is removably coupled within each said U-shaped channel section.

7. The portable seat of claim 3 wherein said means for removably coupling said seat to said first cross elements of said first and second members comprises:

a pair of generally U-shaped channel sections at least one leg of which section is resiliently flexible, said pair of channel sections being coupled to said seat and disposed such that each lies adjacent to the other with their axes defining a V having its apex coincident with said pivotal means; and a locking projection coupled to said at least one flexible leg of each channel for extension beneath said first cross elements when a said first cross element is removably coupled within each said U-shaped channel section, and for extension beneath said seat coupling means coupled to said second and third cross elements when said seat coupling means is coupled to said U-shaped channels.

* * * * *